US005309716A

United States Patent [19]

Kolbinger

[11] Patent Number: 5,309,716

[45] Date of Patent: May 10, 1994

[54] ROTARY PUMP OR ENGINE WITH SPHERICAL BODY

[76] Inventor: Herman J. Kolbinger, 690 S. Main St., New City, N.Y. 10956

[21] Appl. No.: 873,811

[22] Filed: Apr. 27, 1992

[51] Int. Cl.[5] ..... F02G 1/04

[52] U.S. Cl. ..... 60/519; 60/525; 62/6

[58] Field of Search ..... 60/519, 525, 650, 682; 62/6

[56] References Cited

U.S. PATENT DOCUMENTS

| | | | |
|---|---|---|---|
| 3,815,362 | 6/1974 | Kolbinger | 60/525 |
| 3,978,680 | 9/1976 | Schukey | 60/519 X |
| 3,984,981 | 10/1976 | Redshaw | 60/519 |
| 4,031,703 | 6/1977 | Redshaw | 60/519 |
| 5,127,810 | 7/1992 | Kolbinger | 418/68 |

*Primary Examiner*—Stephen F. Husar

[57] ABSTRACT

There is disclosed a rotary pump or engine or compressor or expander comprising a spherical cavity divided by a pivotable disc into two sections. First and second wedges are pivotally connected at opposed disc surfaces. One wedge may be driven causing the disc to pivot and rotate the second wedge covering and uncovering suitably positioned inlet and outlet ports for transferring fluid. Novel constructions to simplify manufacturing and improve sealing are described. Other features include a transparent housing part, altering the angle between input and output shafts to vary the displacement and output, and a combined compressor-expander interconnected by a Cardan joint to reduce vibration.

8 Claims, 12 Drawing Sheets

ROTARY PUMP OR ENGINE WITH SPHERICAL BODY

RELATED APPLICATION

A copending application Ser. No. 07/636,910, filed Jan. 2, 1991, now U.S. Pat. No. 5,127,810, of which the present application is a continuation-in-part.

BACKGROUND OF INVENTION

This application relates to pumps or engines employing a spherical geometry of the type described in my earlier issued U.S. Pat. No. 3,815,362, and said referenced related case.

In my prior U.S. Pat. No. 3,815,362, the contents of which are hereby incorporated by reference, I describe a rotary engine providing two cooperating Stirling cycle systems, which comprises a spherical cavity divided by a pivotable disc into two hemispherical sections, a heated or hot section and a cold section, interconnected by an external conduit. The hot section is divided by a partition into two chambers. A spherical wedge is rotatably mounted in the cold section and is drivingly connected to a crank shaft. Expanding fluids alternating in the heated section cause the disc to pivot and the wedge to rotate and pivot causing rotation of the crank shaft.

The invention described and claimed in the related case was directed to modified positive displacement device constructions employing the spherical cavity, pivoting disc, and cooperating wedge features novelly arranged to obtain a pump or compressor or an improved engine. The contents of that case are also incorporated herein by reference.

SUMMARY OF INVENTION

The present invention is directed to certain improvements over the embodiments described in the related case.

In the previous case, a feature was that the spherical housing could be composed of two parts, each approximately covering a hemisphere, with one part stronger and thicker because it supported the bearings, with the result that the other part could be thinner and lighter as it had no support function. As one improvement, that lighter part can be made of transparent or translucent material, for example, of plastic to allow visual inspection of the device interior. As a further improvement, by making the said one part rigid and stronger, the bearings can be used to hold the wedge-disc assembly together and to accurately position them within the center of the cavity formed by the spherical housing.

In the previous case, the wedges could have hook-bearing edges to engage similarly-shaped recesses in the disc. The present case describes an improved hook arrangement to reduce wear at the seal joint.

In the previous case, certain seals were shown and described in the device. The present case discloses and claims improved seal constructions to improve the seal and reduce wear. Preferably these seals have a cone-shape. As a further improvement, spring means are provided to push the seals into sealing engagement to reduce leakage.

A further improvement described and claimed in the present case is a device construction that allows a variable displacement and thus a variable output, obtained by shifting a wedge over a range of movement of about 25°, which will produce outputs ranging from 100% to 0%.

A further improvement is in the assembly of two units coupled together to form a compressor-expander. In the improved version, two check valves are added to prevent the working fluid from flowing back into the compressor. Moreover, when the two units are coupled together, a double Cardan joint is formed of the coplanar intersecting type, which will reduce vibration in the system. This also minimizes the relative motion between the two systems. It can also form a Cardan joint of the coplanar parallel type.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described the preferred embodiments of the invention.

DETAILED DESCRIPTION OF PREFERRED EMBODIMENTS

Figure 1:
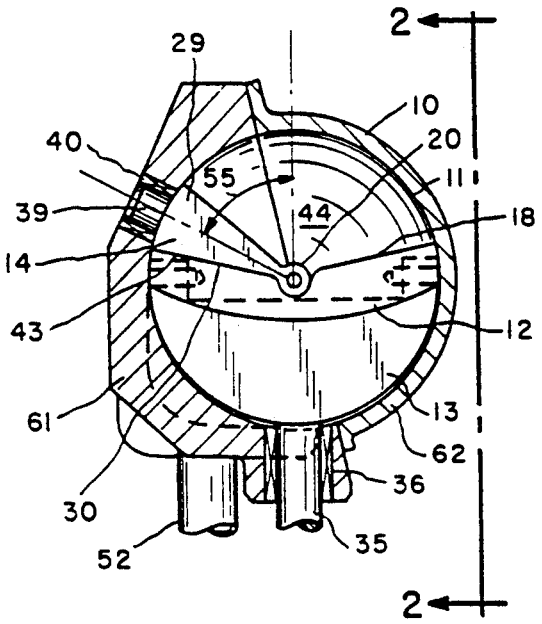
FIG. 1 is a plan view of a first embodiment in accordance with the prior invention, with the housing sectioned along the center, along the line 1—1 of FIG. 3.

Referring now to the drawing, FIGS. 1–4 show one embodiment of my pump in accordance with the prior invention. The pump, in this first embodiment, comprises a fixed housing 10 containing an interior cavity 11 shaped to form the major portion of a sphere. Housed within the cavity 11 are the three principal moving parts of the pump, comprising a disc 12, a first driving wedge 13 and a second driven wedge 14.

The disc 12, whose diameter is slightly less than the diameter of the spherical cavity 11, has a peripheral surface substantially matching that of the cavity in order to allow the disc to rotate or pivot within the cavity. Each side 17, 18 of the disc 12 has a radial concavity and a semi-cylindrical convex portion 19, 20 along a diameter thereof. Each convex portion 19, 20 is located in the disc radial concavity, which as will be observed, curve in orthogonal planes, with the result that the convex portions are also orthogonal. This construction allows the axes of the convex portions 19, 20 to extend in the same plane orthogonal to one another and to intersect one another at the disc center, which coincides with the sphere center. Thus the wedges can pivot about orthogonal axes that intersects at the disc center, which is also the center of the cavity 11.

Each of the wedges 13, 14 may have a similar shape. Their outer periphery 25, 26 is shaped as a sphere section to mate with and ride on the interior surface of the spherical cavity. The remaining wedge surface at the wedge apex is provided with spaced cylindrical projections 27, 28 adapted to mate at opposite sides with the convex portions 19, 20 of the disc 12. The remaining faces 29, 30 of the wedges may be flat and include an angle between them of generally 90° or less. In this design, the wedge is at 15°; however, this is not considered to be limiting. The preferred angle is determined by the intended use.

The disc 12 and wedges 13, 14 are interconnected by fitting the wedge projections 27, 28 over the ends of the disc convex portions 19, 20 and inserting a short pin 31 at each end to pin them together. Suitable seals are provided, not shown, at this interconnection if desired to restrict fluid leakage as the disc 12 pivots during operation about the axes of the pin connections.

A drive shaft 35 for the pump is journalled 36 in the housing wall. The drive shaft 35 is fixedly secured 37 to the center of the spherical surface 25 of the driving wedge 13. When the shaft 35 is rotated by a suitable motor (not shown), the driving wedge 13 also rotates about the shaft axis. The center of the spherical surface 26 of the driven wedge 14 is secured to a short rod 39 journalled 40 in the housing wall. The driven wedge 14 rotates about the rod 39 axis.

The disc 12 divides the cavity 11 into two sections, each of which is divided by their associated wedge into two chambers 41, 42 and 43, 44. Each section has an inlet port 45, 46 and outlet port 47, 48. A first external conduit 50 interconnects the two inlet ports 45, 46 to form a common inlet 52, and a second external conduit 51 interconnects the two outlet ports 47, 48 to form a common outlet 53.

Operation of this first embodiment is as follows. The disc, as mentioned, divides the cavity into two fluid-tight halves or sections, each housing one of the wedges. Each wedge in turn divides its section into two chambers, thus totalling four chambers that can be cycled at 90° to each other. This can be seen as follows. FIG. 1 shows the driving wedge 13 occupying a mid-position defining equal-sized chambers 41 and 42 (see FIG. 2). The driven wedge 14 occupies a closed position lying close to the disc defining a small sized chamber 43 (volume close to zero) and a large sized chamber 44. In one-quarter cycle (90° rotation of driving wedge 13), the driving wedge 13 will be close to the disc, contracting chamber 41 volume close to zero and expanding chamber 42 to its maximum volume, while the driven wedge 14 will have moved to its midposition, making chambers 43, 44 of equal size. At the one-half cycle position (driving wedge rotated 180°), the geometry of FIG. 1 will look the same, except that the opposite wedge surface 29 of driven wedge 14 will be close to the facing disc surface, contracting chamber 44 volume to zero and expanding chamber 43 to its maximum value, and the driving wedge 13 is at its midposition. The three-quarter cycle position corresponds to the one-quarter cycle position except that chambers 43 and 44 are equal sized, and chamber 41 volume is maximum and chamber 42 volume is minimum. The four-quarter cycle position (full 360° rotation of driving wedge 13) corresponds to the parts position illustrated in FIG. 1.

Figure 2:
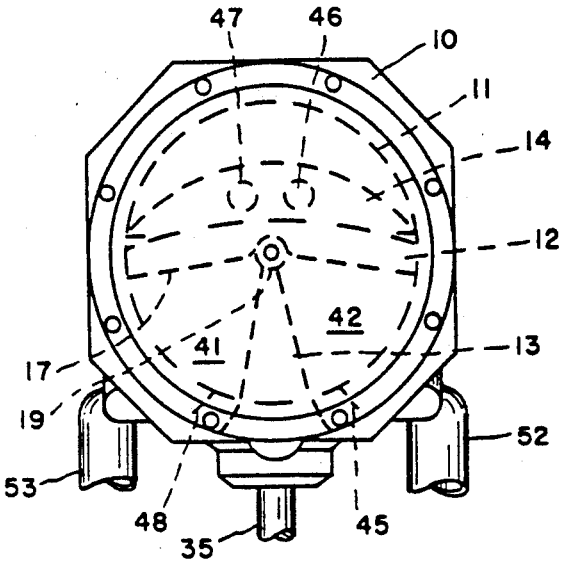
FIG. 2 is a side view of the first embodiment of FIG. 1, taken from the right side of FIG. 1.
Figure 3:
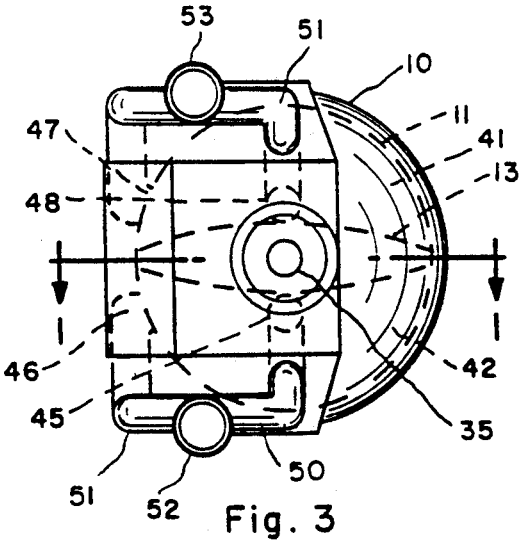
FIG. 3 is a bottom view of the first embodiment for FIG. 1, also taken from the bottom side of FIG. 2.
Figure 4A:
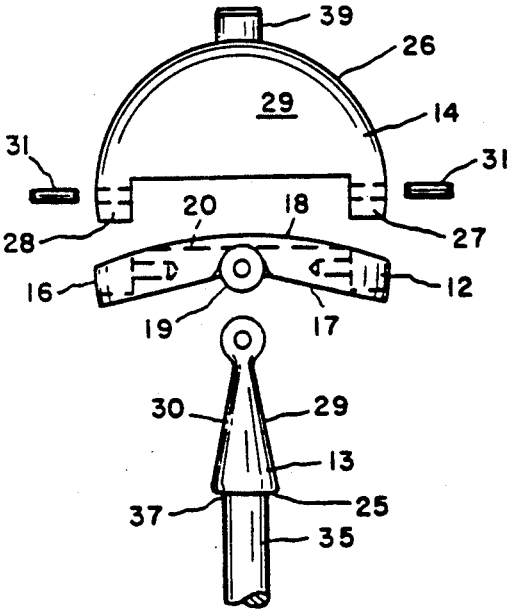
FIGS. 4*a* and 4*b* are, respectively, an exploded view and an assembled view of the disc and two wedges showing one form of suitable interconnection.
Figure 4B:
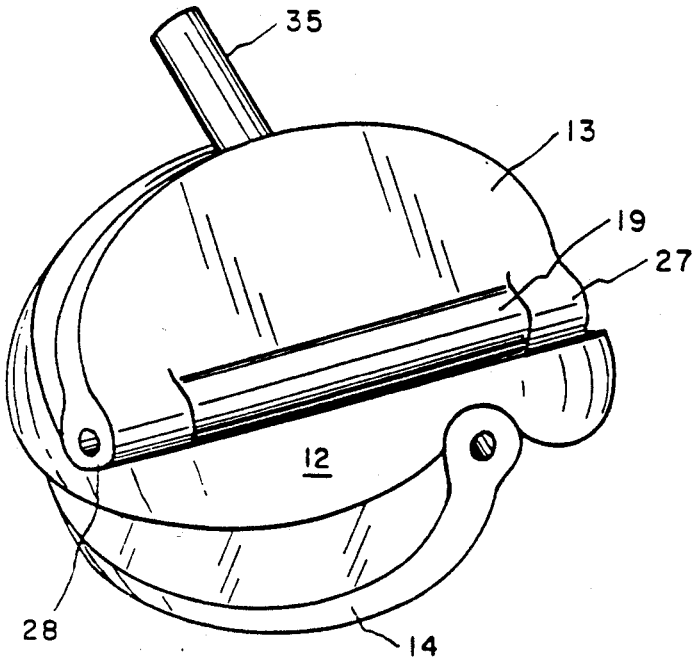

The driving wedge performs two functions. First, it functions to cover and uncover the inlet 45 and exhaust 47 ports in its cavity half to accomplish fluid intake and exhaust. Second, it drives the disc. The disc 12 performs three functions. First, its eccentric rotation in cooperation with the driving wedge 13 causes expansion of one chamber 41 while the inlet port 45 is uncovered to draw fluid into it, while fluid in the second chamber 42 is impelled out the outlet 47 as the volume of the latter contacts, the fluid then transferring to the second chamber as the disc continues its rotation. Second, it drives the driven wedge 14. Third, its cooperates with the driven wedge 14 in the second section similarly to that with the driving wedge to draw fluid into one chamber 43 of the second section through its inlet port 46 and transfer fluid via the adjacent chamber 44 through its outlet port 48 as the disc rotates. The angle of the axes of rotation of the two wedges, designated 55 in FIG. 1, controls the displacement of the disc and the pump output. Thus if the axes were aligned, zero output would be obtained. As the angle 55 increases, increased disc displacement results and increased pump output. FIG. 1 illustrates a construction offering maximum displacement. As will be clear from the foregoing, the inlet and outlet ports are located in such manner on the cavity walls, and the wedge is dimensioned such that the inlet port is uncovered for the required time during the intake cycle to fill the first chamber with fluid, both ports remain partly covered during fluid transfer to the second chamber, and the outlet port is uncovered for the required time to displace the fluid out the outlet during the exhaust part of the cycle. As one example, which is not to be considered limiting, for a spherical cavity with an I.D. of about four inches, and with the ports located as illustrated in FIGS. 1-3 and with a typical port size of about one-half inches, a typical wedge angle would be about 15 degrees. In this embodiment, both inlet and outlet ports remain covered during only a small fraction of the cycle, and remain uncovered at least in part during the remainder of the cycle, so that fluid can be drawn in during expansion of the input chamber and fluid exhausted during contraction of the output chamber. The eccentric disc motion is similar to that described in U.S. Pat. No. 3,815,362, to which reference is made for a clearer understanding.

The pump in accordance with my invention offers the following advantages. Only three moving parts are required, reducing cost and simplifying repair. It offers large positive displacement enabling high volume output in compact pump sizes, and for large sizes relatively low weight. It will also operate at low noise levels. Adequate sealing of the mating surfaces with conventional seals can be easily obtained, due to the simple spherical geometry. In addition, the spherical geometry lends itself to the use of gap sealing with a suitable lubricant.

The FIG. 1 embodiment described how the angle 55 between the axes of rotation of the two wedges controls the displacement of the disc and thus the pump output. FIG. 22 shows a modification that allows that angle 55 to be varied and thus the pump output. The same reference numerals are used for similar elements. The housing comprises hemispherical parts 10-1, 10-2 enclosing on the inside a driving wedge 13 mounted on an input shaft 35, a disc 12, and a driven wedge 14-2. The latter has a recessed interior containing a wedge mounting slide 402 which is supported by a spherical slide member 404 which is slidingly mounted on the outside of the cover 10-2 provided with a wide slot 405. The slide member 404 covers the slot 405 and seals the interior via seals 407. The mounting slide 402 has an end portion 408 sealed at 409 and containing a bearing 410 within which rotates the wedge 14-2. That axis of rotation 412 is adjustable relative to the rotation axis 414 of the shaft 35 over the angle 55. The angle 55 can be varied by a mechanism 415 comprising, as an example only, a hydraulic cylinder 420 fixedly mounted by member 421 on the cover 10-2. The piston rod 423 of the cylinder 420 is pivotally connected 424 to the slide member 404. By actuating the cylinder 420, the slide 404 can be moved along an arc varying the angle 55 from, say, below 0° to 45°. The associated wedge 14-2 can freely rotate about its adjustable axis 412 thereby covering and uncovering input/output ports 425 in the housing wall. The other spherical wedge 13 covers and uncovers input/output ports (not shown) as previously described. In the position of the slide 404 shown, maximum output occurs. When the slide 404 is slid downward so the angle 55 is set to 0°, zero output occurs. If moved below 0°, input ports would become output ports and the output would increase again. If the construction were used as a transmission, this would allow a reversal of the motion.

In the FIG. 22 embodiment, all four chambers displace the working fluid with two intake and two output ports. This configuration gives maximum output or swept volume. By modifying the geometry of the spherical device as shown in FIG. 2, two chambers which displace the working fluid would result. The two working chambers would have one input and one output port. The output of this configuration is 0.5 of the maximum with one wedge opening and closing the ports. FIGS. 23A and 23B show a further variation (similar elements have the same reference numerals) with four chambers in which all four chambers displace the working fluid with one intake 451 and one output 452 port and a connecting port 450 in the disc 12 that connects one of the ported chambers with a non-ported chamber. The output of this configuration is 0.7 of the maximum output.

Figure 22B:
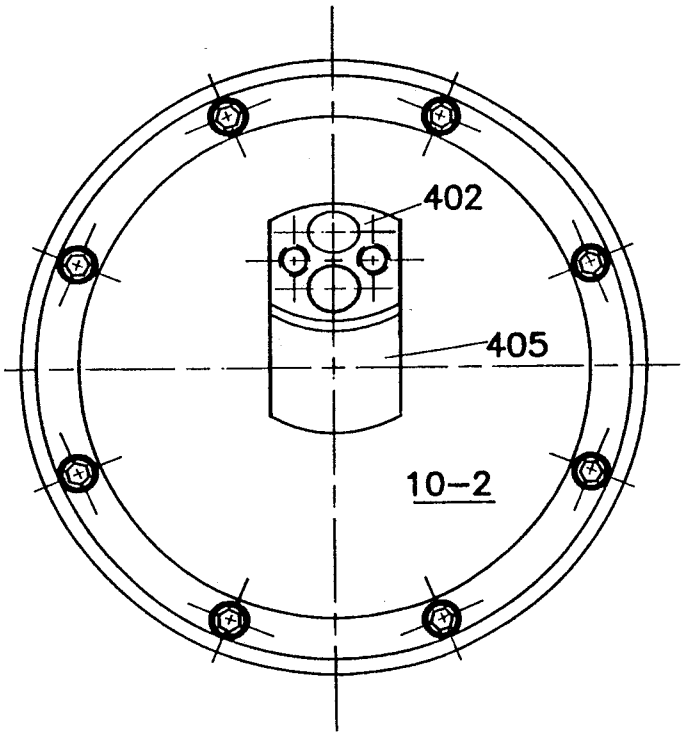
FIGS. 22A and 22B are, respectively, a cross-sectional view through the center of a variable displacement embodiment, and a view with the cover removed to show the internal wall slot.
Figure 22A:
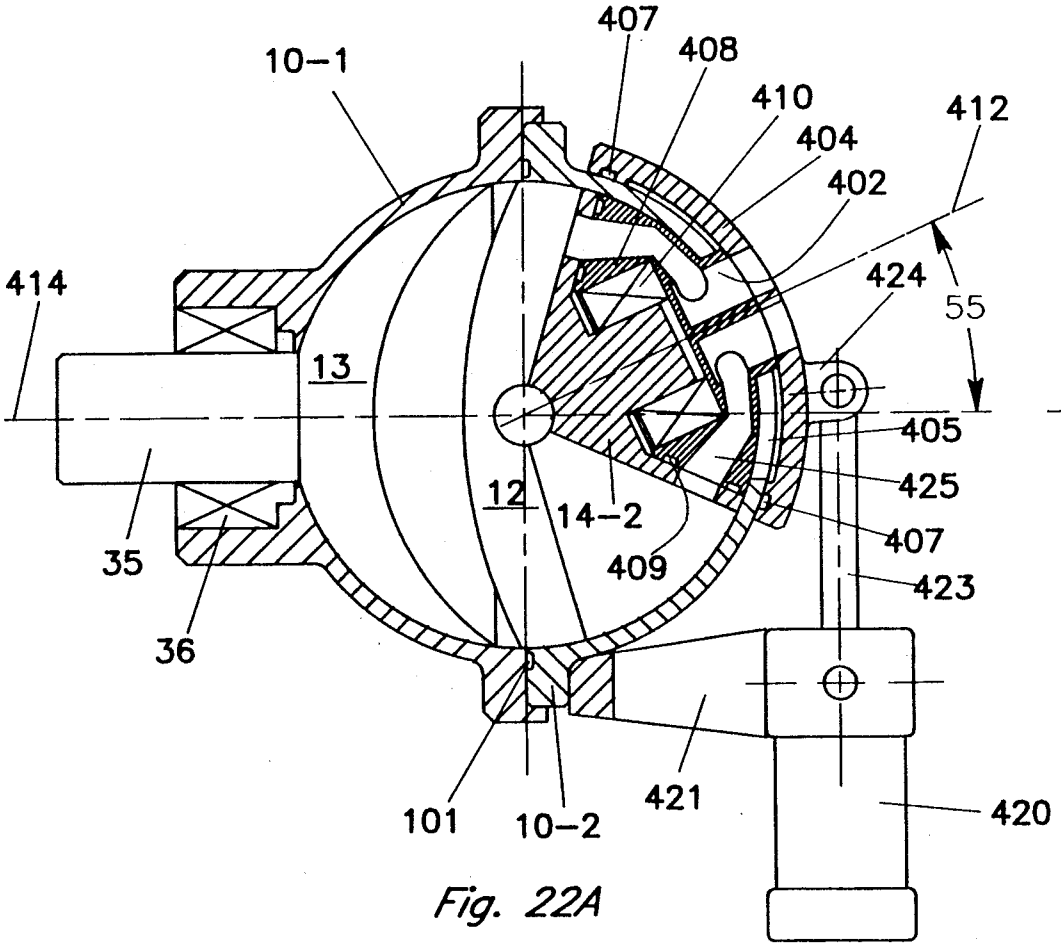
Figure 23B:
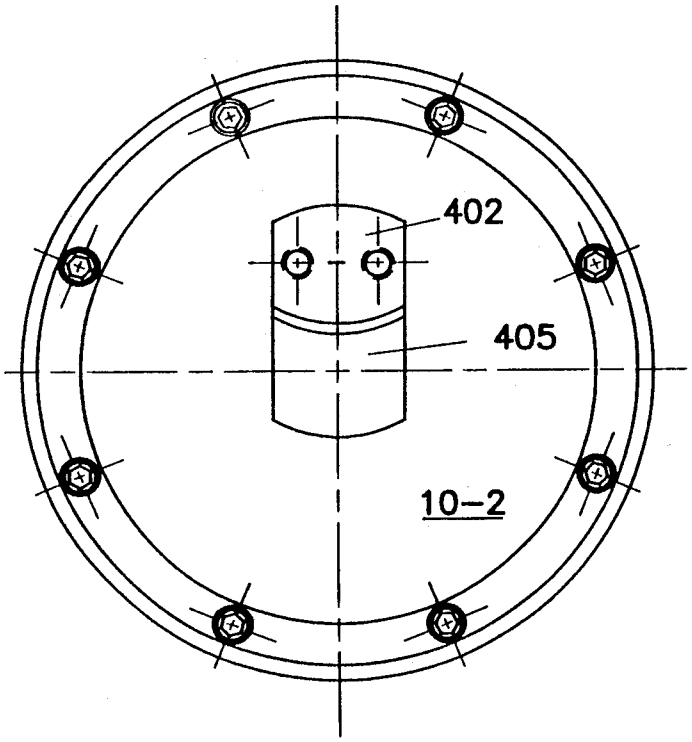
FIGS. 23A and 23B are views similar to FIGS. 22A and 22B of a modification of the variable displacement embodiment.
Figure 23A:
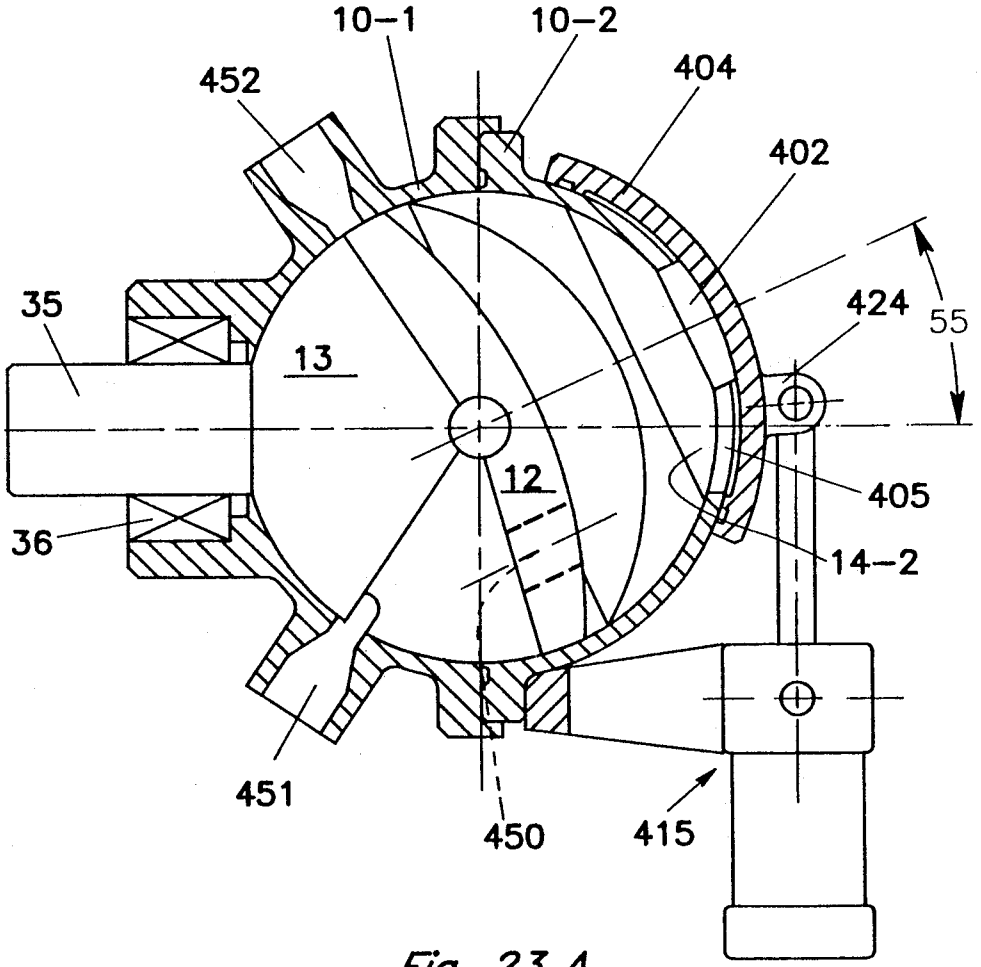

FIG. 22B is an inside view of the removed cover 10-2 to show the slot 405 which is machined through the cover wall.

Figure 5A:
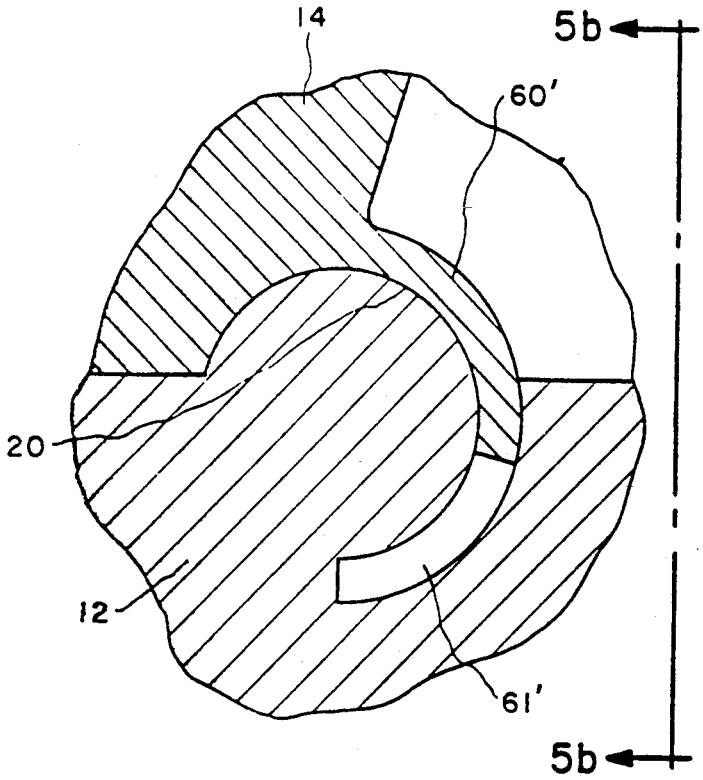
FIGS. 5*a* and 5*b* are, respectively, a partly sectional and side view of a modified wedge showing another form of suitable interconnection to the disc.
Figure 5B:
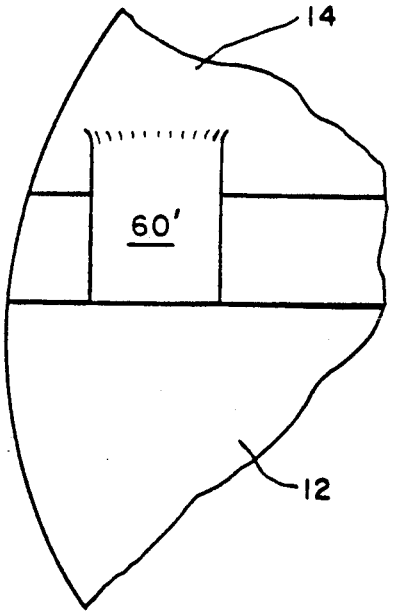

FIG. 5 is a perspective view of a modified form of mounting of the wedges on the disc for the FIG. 1 embodiment. The wedge cylindrical projections are replaced by a pair of curved hook members 60′ whose axis of symmetry coincides with that of the projections of the other embodiment. The hook members 60′ are shaped to engage similarly shaped recessed portions 61′ located at the disc convex portions and whose axes of symmetry coincide with convex portions. The pins 31 may be omitted since the cavity walls keep the wedges from separating from the disc.

Figure 8:
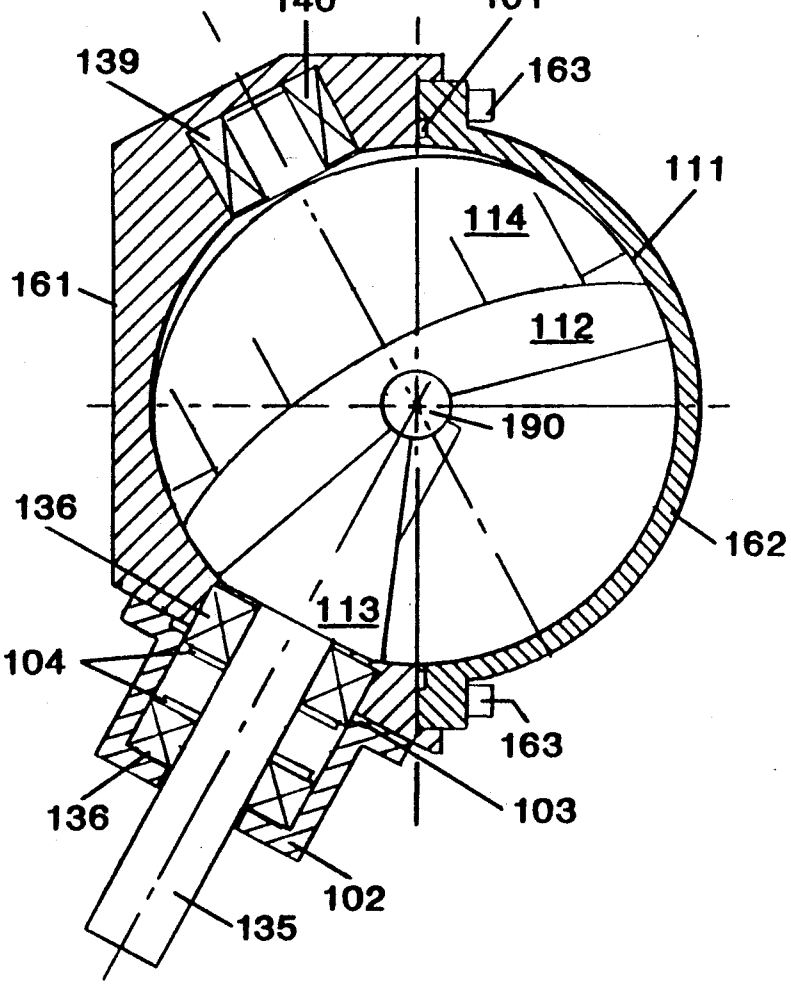
FIG. 8 is a cross-sectional view through the center of a third embodiment in accordance with the invention.
Figure 11:
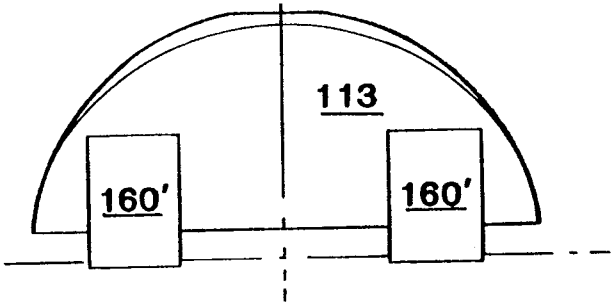
FIG. 11 is a side view of the wedge of FIG. 10.
Figure 13:
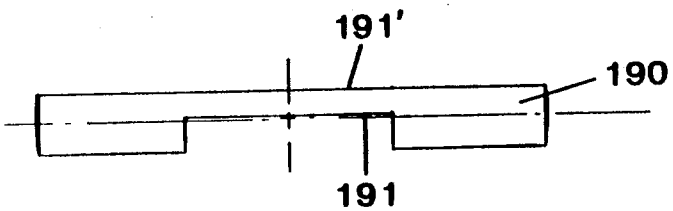
FIG. 13 is a side view of the wedge bearing rod of FIG. 12.
Figure 10:
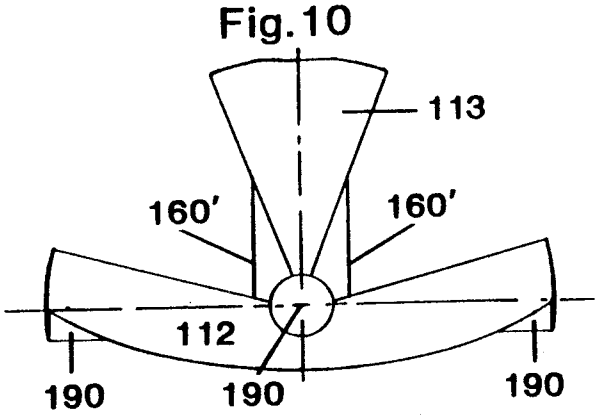
FIG. 10 shows how the disc and wedge fit in the third embodiment.
Figure 12:
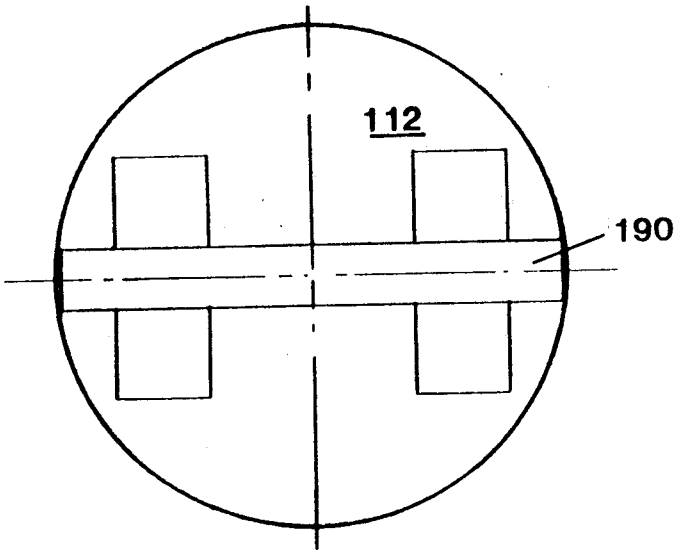
FIG. 12 is a plan view of the disc alone of FIG. 10.
Figure 15:
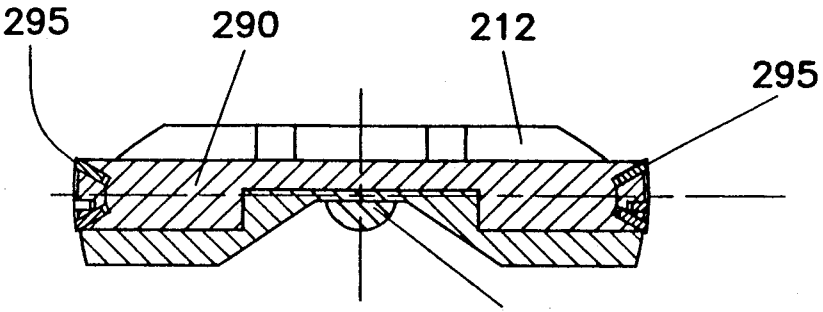
FIG. 15 is a cross-sectional view along the line A—A of FIG. 14.
Figure 21C:
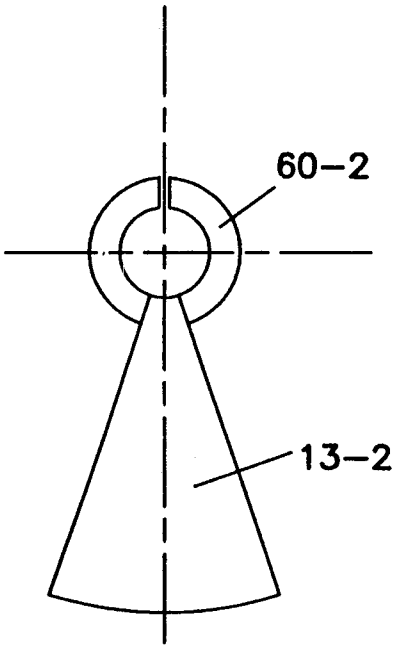
FIGS. 21A, 21B and 21C show, respectively, in top, side and end views a modified form of the FIG. 5 construction for mounting of the wedges on the disc.
Figure 21B:
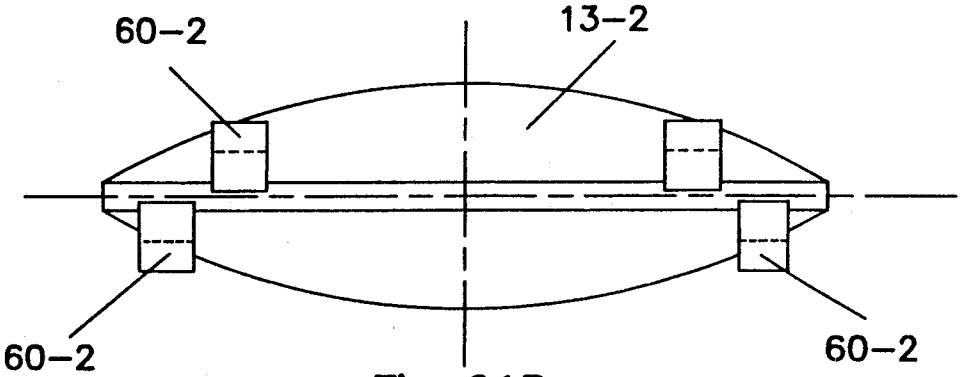
Figure 21A:
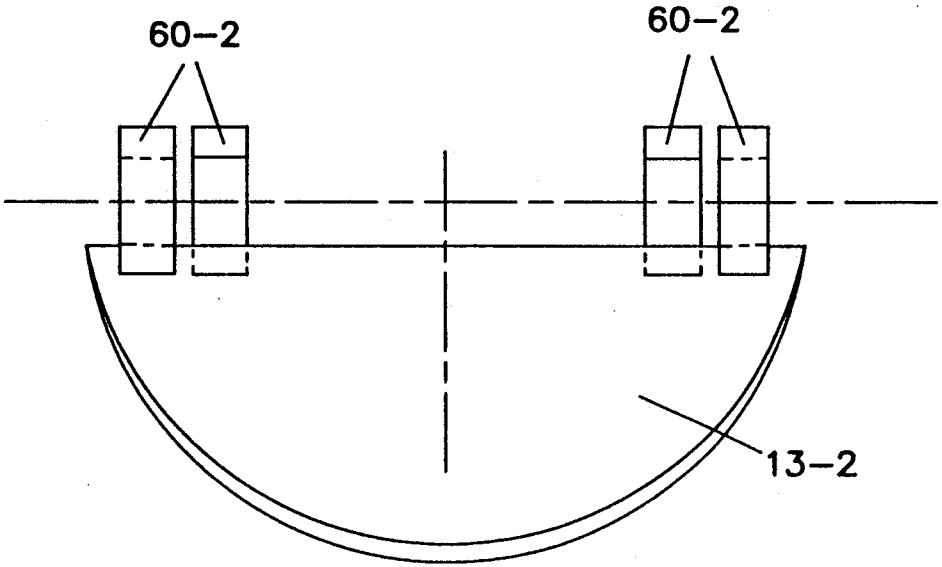

FIGS. 21A-C show, in comparison with FIG. 5, a modified form of wedge-to-disc mounting to reduce wear at a seal mounting. Each of the wedges is provided at its edge with two sets of spaced ring-like hooks for engaging recessed areas on the disc. FIG. 21 shows the hooks just for one of the wedges 13-2; the other wedge would have a similar construction. The two hooks 60-2 in each set are also slightly spaced apart. When assembled to the disc in the manner illustrated in FIG. 8 with seals between the hooks in each set, wear at the seal location is reduced. The ring-like hooks would embrace a bearing rod of the type illustrated at 190 in FIGS. 12 and 13 to form the desired straight sealing area.

Figure 5C:
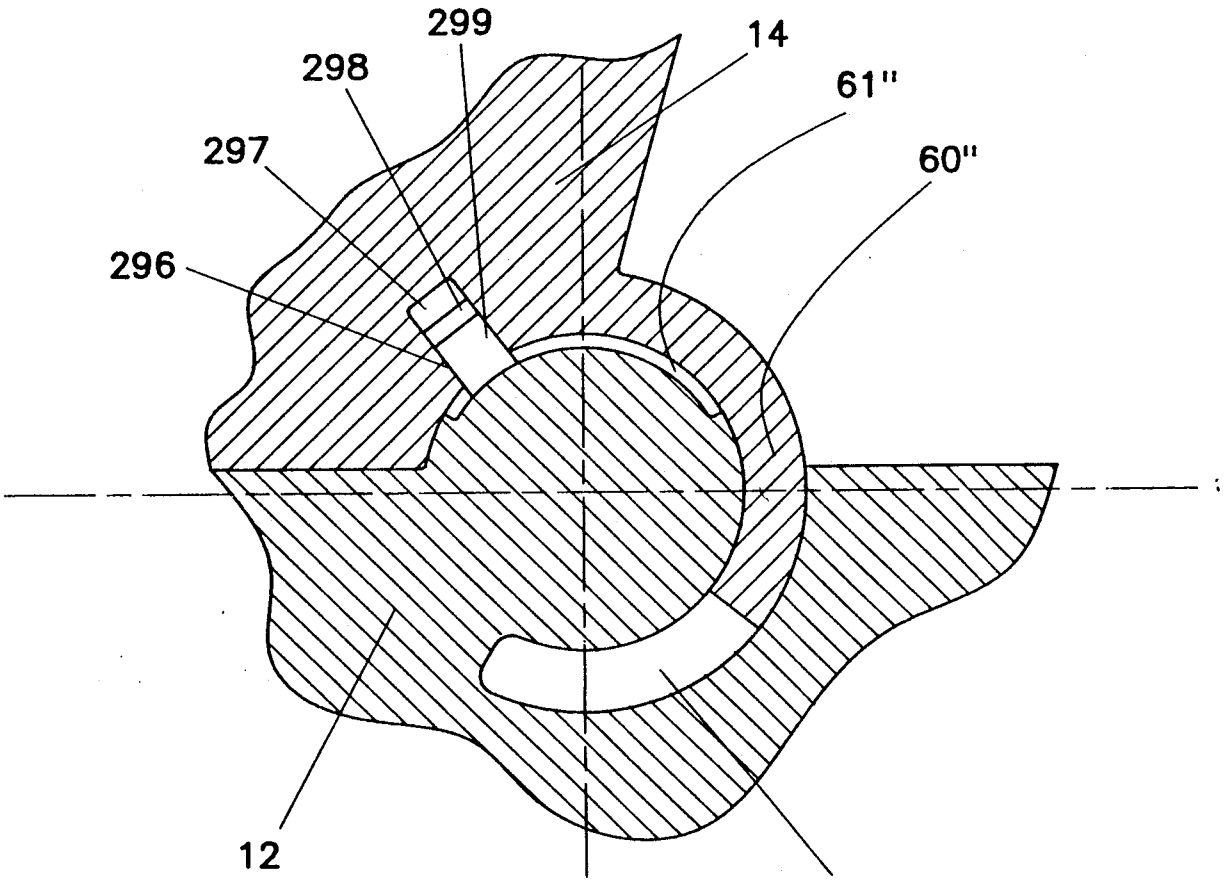
FIG. 5*c* is a view similar to FIG. 5*a* of a wedge connection in accordance with the present invention.
Figure 17:
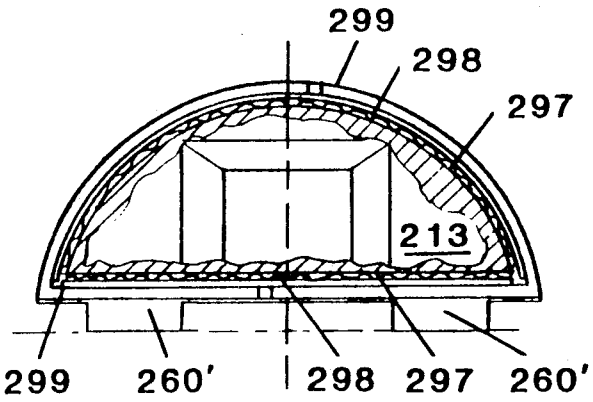
FIGS. 17–19 show, respectively, a plan, side, and top view of a wedge for use in the third embodiment.

FIG. 5c shows a further variation to reduce scoring. The recessed region 61′ is undercut at 61″ so that when a seal 297, 298, 299 similar to that of FIG. 17 is located in the seat 296, only the seal rubs over the undercut area and not the hooks themselves so that the latter cannot score the sealed bearing area.

To assemble the pump of FIGS. 1-3, as illustrated in FIG. 1, the housing 10 is constructed in two halves 61, 62 which may be suitably fastened together along mating flanges as shown, by for example screws.

Figure 6:
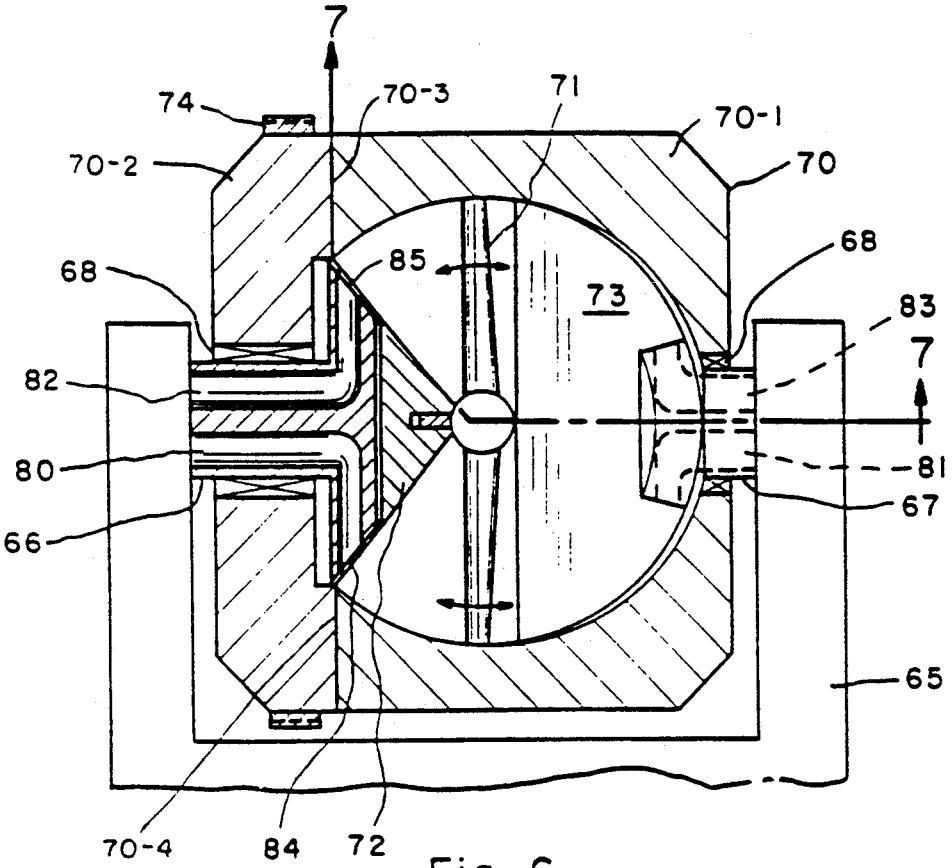
FIG. 6 is a cross-sectional view of a second embodiment in accordance with the prior invention.
Figure 7:
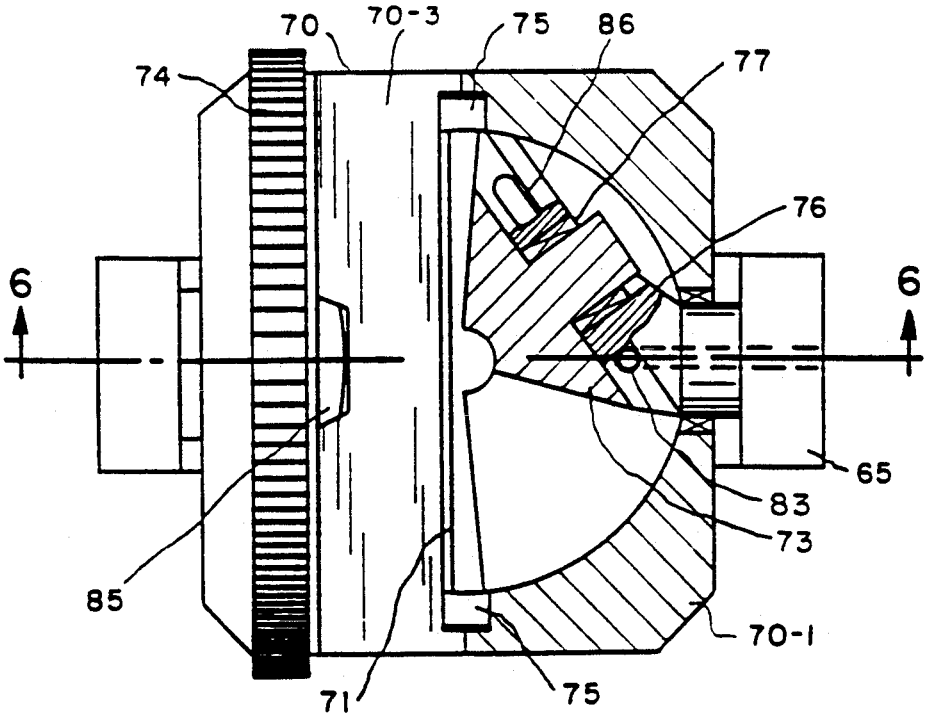
FIG. 7 is a partly cross-sectional, partly elevational view taken along the line 7—7 of the second embodiment of FIG. 6.

FIGS. 6 and 7 illustrate a second embodiment of a pump in accordance with my invention. In this embodiment, a fixed support 65 is provided, for opposite sides of which project inwardly a pair of aligned, opposed, hollow shafts 66, 67. On these hollow shafts is journalled by suitable bearings 68 a housing 70 containing the spherical cavity, and housing as in the first embodiment a disc 71 and a driving 72 and driven wedge 73. The housing 70 can be rotated in any known manner. For instance, a gear 74 can be mounted on the housing periphery for rotation by a conventional electronic motor. Alternatively, the housing can be pulley driven. To obtain rotation of the first wedge 72, the wedge 72 is anchored to the housing walls in any suitable manner.

The wedge 72 thus rotates with the housing 70 about a fixed axis, the shaft 66 axis of rotation, as in the first embodiment. The disc 71 is similar to that of the first embodiment, and the disc pivot connections to the first wedge and second wedge are similar to that of the first embodiment. However, in the second embodiment, the disc 71 is pivotally mounted at its periphery along a diameter to housing walls as shown at 75. Thus, the disc rotates with the housing but also pivots about an axis through its center, as shown by the arrows in FIG. 6.

The journalling of the second wedge 73 is also different. Instead of rotating about a fixed axis, the wedge 73 is drivingly connected to an offset arm 76, similar to a crank arm, which is in turn fixed to the other hollow shaft 67. The wedge 73 is journalled 77 on the offset arm 76 for rotation about the wedge axis. Thus, when the rotating driving wedge 72 causes the disc 71 to pivot, the effect is to cause the driven wedge 73 to follow an eccentric motion within the right hand cavity section of FIGS. 6 and 7 quite similar to the motion followed by the wedge in the embodiment of FIG. 3 in my referenced patent.

Because of the rotating housing, the exhaust ports cannot be conveniently located in the housing walls and are thus located within the hollow shafts. Thus, reference 80 designates the exhaust port of the left section of the cavity, and reference 81 designates the exhaust port of the right section of the cavity. It is convenient to locate an intake port 82 for the left cavity section in the hollow shaft 66, in view of the fixed axis of rotation of the driving wedge. However, in the right cavity section, in view of the eccentric motion of the driven wedge, the intake port can if desired be located in the housing wall (not shown) to be covered and uncovered in the proper sequence. This construction is suitable for a compressor, wherein the fluid is a gas such as air. For a liquid fluid, an intake port 83 can also be located in the same hollow shaft 67. As shown, it extends along a groove 86 along the periphery of the offset arm 76. As will be observed, the driving wedge 72, which has a tapered crossection, has solid walls 84 with an opening 85 so that as it rotates the intake and exhaust ports are covered and uncovered in the desired sequence.

What is also different in this embodiment is the way in which the spherical body is constructed. It is constructed in two parts 70-1 and 70-2, sealed together at the boundaries indicated by 70-3, 70-4. This kind of seal, extending as it does over several quadrants of the sphere, is less likely to leak in high-pressure applications.

The pump illustrated in FIGS. 6 and 7 operates similarly to the first embodiment and offers similar advantages.

Both embodiments can be operated with liquid and gaseous fluids.

One of the features of the first embodiment, evident in FIGS. 1-3, is that the journals 36, 40, and the ports 45, 48 are all located in one half of the spherical body. This allow both journal bearings to hold the wedge and disc assembly together and accurately position them within the center of the spherical cavity in such a way that it forms a small gap between the housing wall and the outer perimeter of the wedge and disc assembly. The bearings absorb all the of the forces. The spherical cavity is only touched when excessive forces are experienced. That half 61 can be constructed to be rigid and stronger to take the additional loads thus involved, whereas the second half 62 can be constructed as a thin cover member which fits over and seals to the first half 61. This simplifies the sealing of the two halves, and makes it easier to locate more accurately the journals and ports in the heavier body half. As a further improvement of this case, the second half can be made transparent or translucent, for example of clear plastic, which would allow viewing the interior to ease repair and maintenance.

This feature is also shown in the third embodiment illustrated in FIGS. 8-19. As before, a spherical cavity 111 is formed by a body comprising a heavy half 161 to which a lighter half or cover 162, which may also be transparent, is bolted 163. A single O-ring seal 101 can be used to seal the two halves together. The driving shaft 135 has journals 136 located in a bearing block 102 and sealed by an O-ring 103 to the heavier half 161. To the shaft 135 is attached a first wedge 113 journalled on one side of a disc 112 on whose opposite side is journalled a second wedge 114 also journalled 140 in the rigid half 161 via a shaft 139. Items 104 can be rotary seals for the shaft 135. As in the earlier embodiments, the wedge-disc journals are orthogonal and intersect the sphere center.

Figure 9:
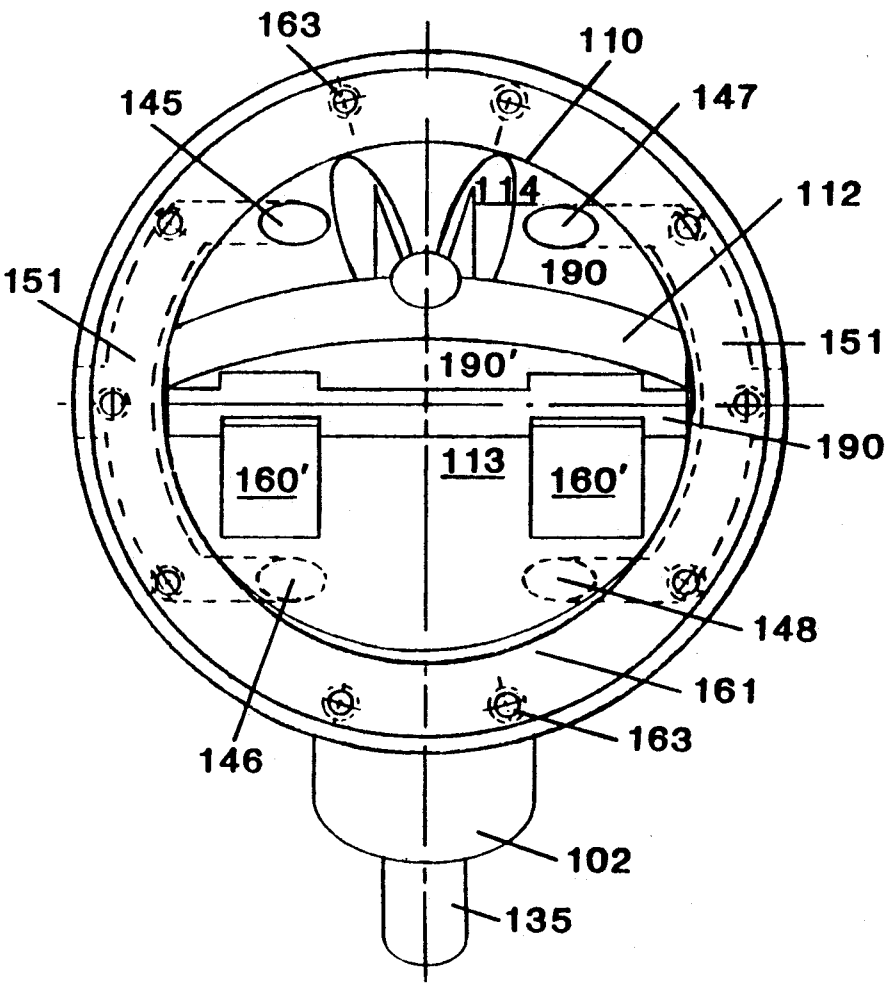
FIG. 9 is a plan view of the device of FIG. 8 with the body cover removed.

FIG. 9 shows the inlet/outlet ports 145, 146 and 147, 148, interconnected by ducts 151.

The disc/wedge bearings are similar to that of the first embodiment, except that separate bearing rods 190 are mounted orthogonally, on opposite disc sides. FIGS. 10-13 also show this feature. The disc 112 is symmetrical, with one side the mirror image of the opposite side except rotated 90°. Here, a bearing rod 190 is mounted, orthogonally relative to the other, on opposite sides at the center of the disc 112, and has a recess 191 fitting over a projecting part 190'(FIG. 9) on the disc. Each wedge 113, 114 has two pairs of projections 160' extending from its straight side. These embrace the bearing rod 190 on its top solid surface 191' opposite the recess 191. The journal bearings prevent the assembly from coming apart. The result is that a straight sealing area is provided between each wedge and the disc along the surface of the rod 190, which, as in the FIGS. 1-4 embodiment, will have less leakage.

Either of the paired ports can serve as inlets or as outlets. A feature is that the inlet ports can readily be aimed toward the sphere center. To the working fluid can be added an oil mist. The oil mist will then hit the center of the bearing rod 190, at its upper surface 191', and centrifugal forces will cause the oil to spread outwardly over the entire bearing rod surface thus providing automatic and continuous lubrication of the disc-wedge pivot bearing. The oil can also act as a sealing medium of the peripheral disc and wedge surfaces where they contact the spherical cavity.

Figure 14:
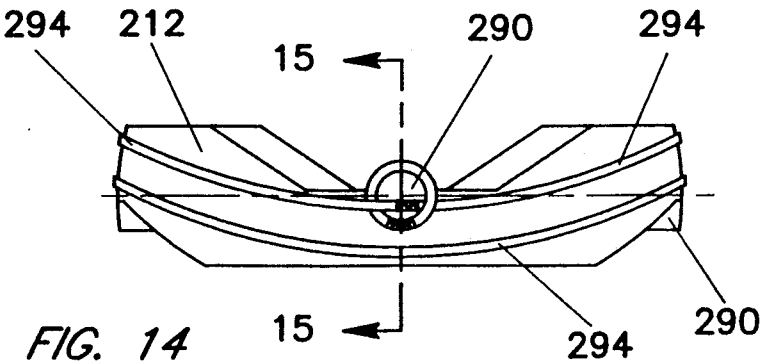
FIG. 14 is a side view of a modified disc of the third embodiment.

FIGS. 14-19 show modified disc and wedge constructions providing additional built in seals to reduce or avoid leakage between the different chambers in the device. The outer configuration of the disc 212 is similar to that of the disc 112, and the same bearing rod construction 290 is employed. Along the outer periphery of the disc 212 are provided four annular grooves 292, each extending 180° but circumferentially displaced 90° from each other. In each groove 292 is seated a corrugated metal spring 293 biasing outwardly a seal member 294. Three of the seals 294 are shown in FIG. 14. These seals improve the sealing of the disc 212 to the spherical cavity. The bearing rods 290 are also provided at their ends with special seals in the form of split conical shells 295 whose outer widened end engages the spherical cavity surface.

Figure 18:
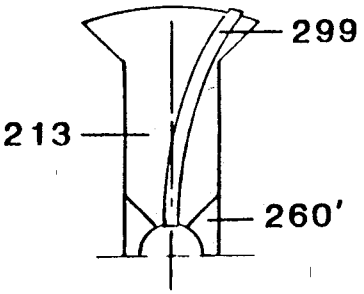
Figure 19:
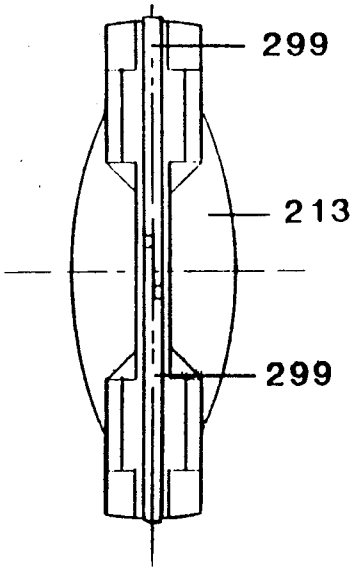

The wedge 213, can be given similar additional sealing, shown in FIGS. 17-19. Grooves 297 in the circular and straight sides house a spring-biased 298 seal member 299 for engaging the spherical cavity wall as well as the surface of the bearing rod 290. These extra seals will prove especially useful to compensate for thermal expansion of the rotating parts. These seals also serve as backup seals to block the gas passages created by the lap joint formed where the wedges 213 engage the bearing rods 290.

This third embodiment can be used as a fluid compressor or pump, or expander, in which latter case it can also function as a motor when high-pressure fluid is inputted, or as a engine when heated fluid is inputted. Preferably, the parts are made of aluminum for light weight, processed for hardness, good wear and friction characteristics at the bearing surfaces. Alternatively, they can be made of suitable plastic non-reactive with the working fluid. The seals can be of conventional material, such as C-seals, Viton, or ferro-fluidic seals.

Figure 14A:
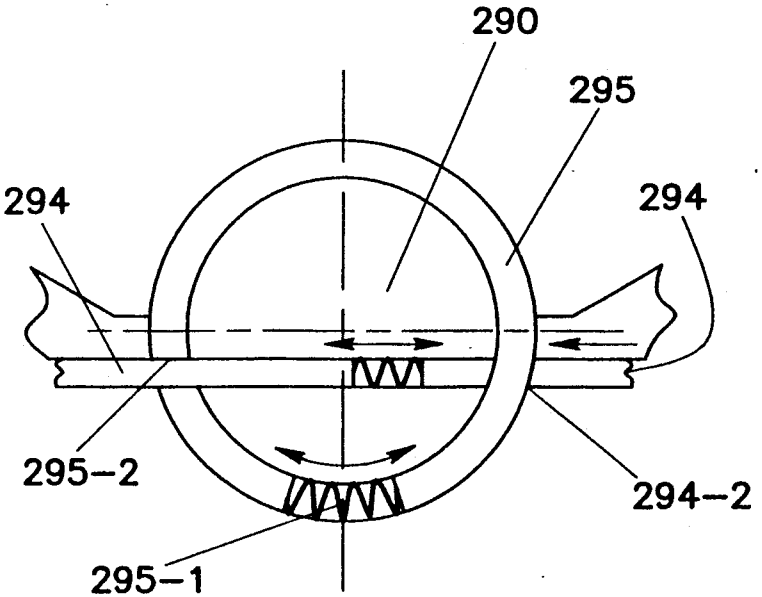
FIG. 14A is an enlarged view at the center to illustrate the improved seal arrangement of the present invention.
Figure 16:
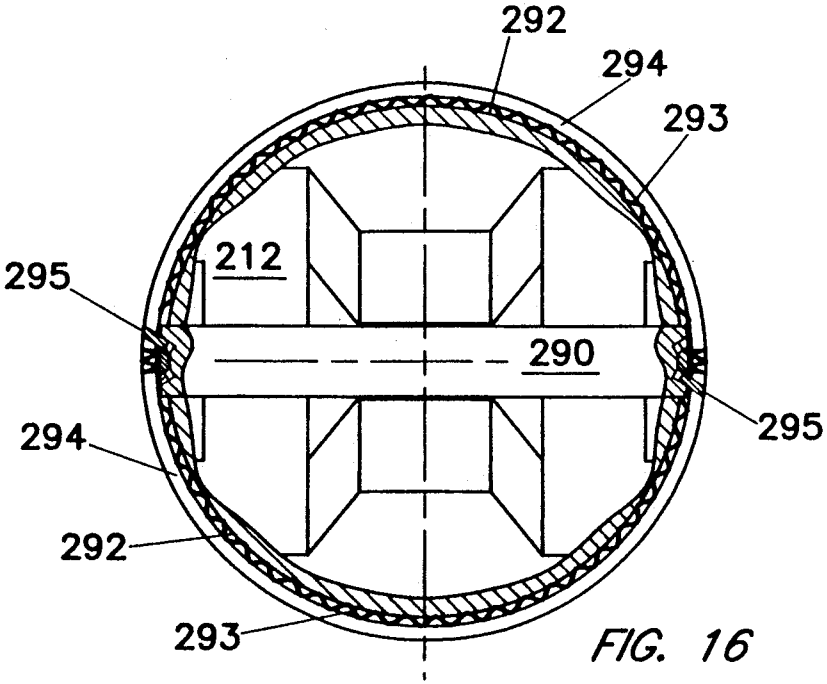
FIG. 16 is a plan view of the disc of FIG. 14.

FIG. 14A is an enlarged view of the center of FIG. 14 providing more detail on the seal construction. It also illustrates that the cone seals 295 are split, with the free ends separated by a spring 295-1, which improves the sealing contact at joint 295-2. The springs 295-1, of which four are provided, may be in the form of U-clips and are effective to improve the action of the outer seals 295. In addition, springs 294-1 are provided to improve the cone seals and improve sealing at the joint 294-2. Four of these, too, are provided, and they may also be U-clips.

Figure 20:
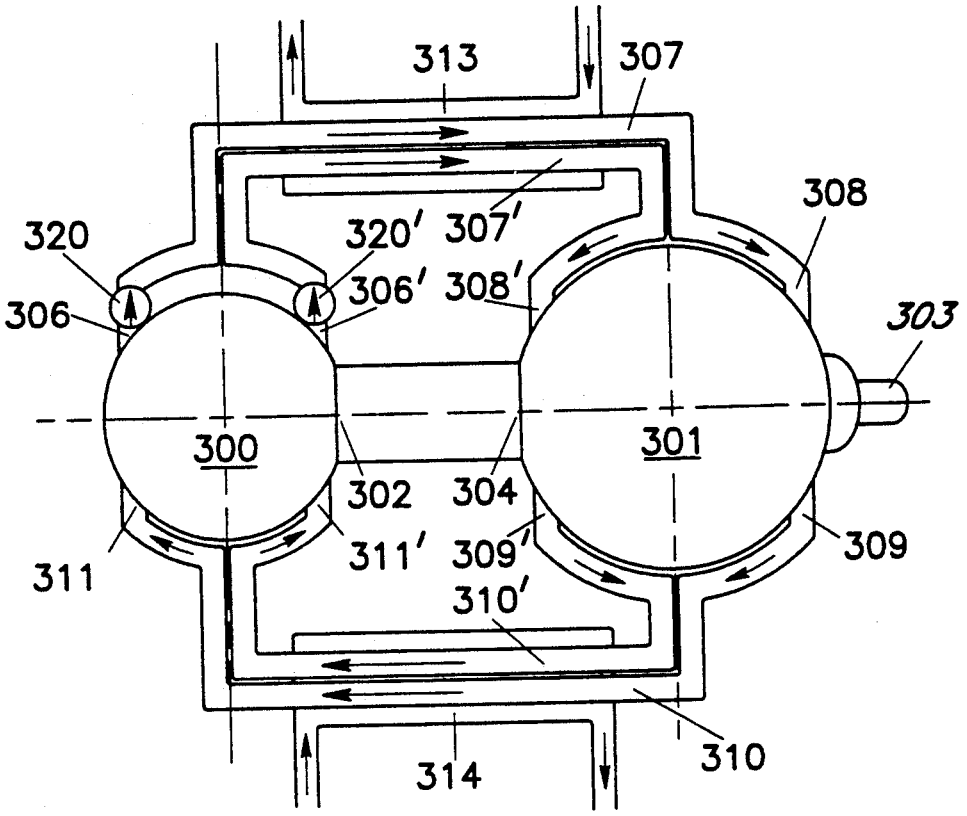
FIG. 20 is a schematic view of two units of the present invention coupled together to form a compressor-expander.
Figure 20A:
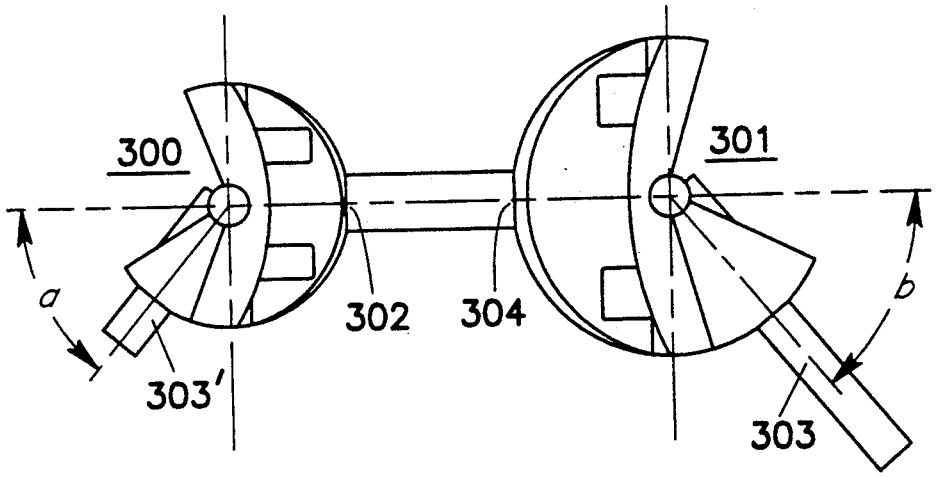
FIG. 20A shows a side view without housing and ducts.

FIG. 20 illustrates an application of the invention in a Brayton or gas-turbine cycle. It comprises two positive displacement spherical devices 300, 301 each similar to one of the earlier embodiments. One unit 300 is a compressor with on output shaft 302, and the other is an expander 301 with two output shafts 303, 304. This spherical positive displacement device is mathematically analogous to a known Cardan joint. Since a sealed Bryton cycle generally requires high internal pressure, velocity fluctuations that are generated between the driving shaft 303 and the driven shaft 304 of the expander 301 and the driving shaft 302 and the driven shaft 303' of the compressor translate into undesirable pressure variations in the working gases which will cause the efficiency of the cycle to drop. To eliminate these losses, it is desirable to use two spherical displacement units connected in a coplanar intersecting fashion. As shown in FIG. 20A, angle (a) is equal to angle (b) and the associated shaft center lines are in the same plane. In such a configuration, the system connected by the driving shaft 302 and the driven shaft 304 has a complementary pressure-phase relationship and therefore forms a system. The second system with a complementary pressure-phase relationship is formed by driving shaft 303 and driven shaft 303'. This also requires that each system has its independent ducting system. The output port 306 of the compressor 300 is connected 307 to the input port 308 of the expander 301. The output port 306' of the compressor 300 is connected 307' to the input port 308' of the expander 301. Check valves 320 are provided in each of the output lines 306, 306' to prevent gas from flowing back into the compressor and can improve compressor efficiency. The output port 309 of the expander 301 is connected 310 to the input port 311 of the compressor 300. The output port 309' of the expander 301 is connected 310' to the input port 311' of the compressor 300. The shafts 302, 304 are coupled together. A heat exchanger 313, 314 is provided between both of the input and output connections as shown. Typically, the expander 301 displacement is chosen larger than that of the compressor 300. The ratio of the volume displaced by the expander 301 to that displaced by the compressor 300 can be selected such that it will operate efficiently at the desired temperature. The working internal pressure of this combination is normally chosen higher than atmospheric pressure. Also, the compressor 300 and expander 301 can be connected in such a way as to cancel out each other's vibrations. This would be accomplished by connecting them such that the movements in one of the two units is opposite to that in the other unit. For example, when the disc in one unit pivots to the left, then the connection would be arranged so that the disc in the other unit is pivoted to the right.

When heat is applied to the heat exchanger 313, the combined device will operate as a heat engine. When rotary power is applied to the output shaft 303, the combined device will operate as a cooler and removes heat from the heat exchanger 313. The components of this combined unit can be designed so that they are molded out of various materials normally not used for engines, such as plastic. Because these units are positive displacement devices, the engine will operate efficiently at variable speeds.

As will be observed in FIG. 20, the gas flows between the two units are divided or separated, with a first and second of the two outlets connected respectively to a first and second of the two inlets. This is desirable and preferred, because excessive forces would tend to get generated if the flows were not separated.

See, for example, the description given in Machine Design, Mar. 7, 1991, pgs. 82–88. When the connection between the connecting shafts forms a double Cardan joint for co-planar intersecting axes or shafts, less vibration occurs. As explained in the referenced journal article, the use of the double Cardan joint can prevent relative motion between driving and driven shafts. The design of a Cardan joint is well known and can be found in the referenced article as well as in many design manuals.

There thus results in accordance with the invention an extremely compact, positive displacement compressor or expander that requires the theoretical minimum envelope size per unit volume of displaced fluid. The device can be used as a compressor, expander, or as an integral expander/compressor. The application areas for this type of device range from compact, long-life aerospace thermal systems to air conditioners and engines for both the home and automobile. It is well-suited for compact heat-activated cooling or power cycles (i.e., Stirling), where it can utilize either solar or low-level waste heat as its prime energy source.

The third embodiment will be also useful as the turbine or compressor of an Escher-Wyss-AK closed-cycle gas turbine system. It can operate with low temperatures, i.e., 100° F., differences. Since it is a positive-displacement device, it will allow efficient operation at both high and low speeds, and thus a substantially constant torque output at different speeds. A further advantage of this cycle is that it allows the use of solid fuel, such as pulverized coal, to heat the working fluid.

While my invention has been described in connection with specific embodiments thereof, those skilled in this art will recognize that various modifications are possible within the principals enunciated herein and thus the present invention is not to be limited to the specific embodiments disclosed.

What is claimed is:

1. A combined device comprising first and second spherical positive displacement devices; each of said devices comprising a housing having a cavity therein shaped to form the major portion of a sphere, a disc having a circular periphery and fitted within the cavity for pivotal movement therein and dividing the cavity into first and second sections, first and second wedge-like members, said first wedge member being pivotally connected at one side of the disc and lying within the first cavity section, the second wedge member being pivotally connected at the opposite disc side and lying within the second cavity section, fluid inlet and outlet means coupled to the cavity, the pivotal axes of the first and second wedge members being orthogonal to one another and extending in the same plane and intersecting at the sphere center, and means for journalling for rotation both the first and second wedge members in the housing; said first device having one output shaft and the second device having two output shafts with one of the latter connected to the output shaft of the first device; a heat exchanger connecting together the respective outlet and inlet means of the first and second devices.

2. The device of claim 1, further comprising heat supply means to a heat exchanger whereby the device operates as a heat engine.

3. The device of claim 1, further comprising shaft driving means for the second device whereby the device operates as a cooler.

4. A combined compressor-expander device comprising first and second spherical positive displacement devices; each of said devices comprising a housing having a cavity therein shaped to form the major portion of a sphere, a disc having a circular periphery and fitted within the cavity for pivotal movement therein and dividing the cavity into first and second sections, first and second wedge-like members, said first wedge member being pivotally connected at one side of the disc and lying within the first cavity section, the second wedge member being pivotally connected at the opposite disc side and lying within the second cavity section, fluid inlet and outlet means coupled to the cavity, the pivotal axes of the first and second wedge members being orthogonal to one another and extending in the same plane and intersecting at the sphere center, and means for journalling for rotation both the first and second wedge members in the housing; said first device having one output shaft and the second device having two output shafts, means for connecting one of the output shafts of the second device to the output shaft of the first device; a heat exchanger, and fluid conduit means connecting together the respective outlet and inlet means of the first and second devices via the heat exchanger.

5. The device of claim 4, further comprising each device having two inlets and two outlets, and separate conduit means connecting each of the two outlets to each of the two inlets.

6. The device of claim 5, further comprising check valves in the conduit means connected to the outlet means of the device functioning as a compressor.

7. The device of claim 5, wherein the connecting means for the shafts forms a joint of the co-planar intersecting Cardan type.

8. The device of claim 5, wherein the connecting means for the shafts forms a joint of the co-planar parallel shaft Cardan type.

* * * * *